United States Patent [19]

Mueller

[11] Patent Number: 5,048,592

[45] Date of Patent: Sep. 17, 1991

[54] PLUNGER FOR A DIECASTING MACHINE

[75] Inventor: Andre Mueller, Ependes, Switzerland

[73] Assignee: Allper AG, Duedingen, Switzerland

[21] Appl. No.: 477,072

[22] Filed: Feb. 9, 1990

[30] Foreign Application Priority Data

Oct. 18, 1989 [DE] Fed. Rep. of Germany ..... 3934778

[51] Int. Cl.[5] ..... B22D 17/20

[52] U.S. Cl. ..... 164/312; 92/246; 92/255; 164/314

[58] Field of Search ..... 164/312, 314; 92/246, 92/255

[56] References Cited

U.S. PATENT DOCUMENTS

| | | | |
|---|---|---|---|
| 1,326,692 | 12/1919 | Rogatchoff | 92/255 X |
| 4,036,113 | 7/1977 | Kunz | 92/111 |
| 4,598,762 | 7/1986 | Glas | 164/312 |
| 4,842,039 | 6/1989 | Kelm | 164/312 |
| 4,886,107 | 12/1989 | Zecman | 164/312 X |
| 4,899,804 | 2/1990 | Hammerer | 164/312 |

FOREIGN PATENT DOCUMENTS

| | | | |
|---|---|---|---|
| 2233132 | 1/1974 | Fed. Rep. of Germany | 164/312 |
| 2904883 | 7/1979 | Fed. Rep. of Germany . | |
| 3323328 | 5/1984 | Fed. Rep. of Germany | 164/312 |
| 57-68257 | 4/1982 | Japan | 164/312 |
| 1080922 | 3/1984 | U.S.S.R. | 164/312 |

OTHER PUBLICATIONS

"Alper AG/SA Stocklist of High Performance Copper Alloys", published: Jun. 17, 1987.

*Primary Examiner*—J. Reed Batten, Jr.
*Attorney, Agent, or Firm*—Foley & Lardner

[57] ABSTRACT

A plunger for forcing molten aluminum or brass out of a casting cylinder of a diecasting machine includes a cap which is screwed via an internal thread onto an external thread of a supporting body and is made of a material, in particular a copper alloy, which has a greater coefficient of thermal expansion than the material of the cylinder, in particular steel, and the material of the supporting body, in particular steel. An inner cover face of the cap bears against a front face of the supporting body and, with its internal thread, is screwed thermally onto the external thread of the supporting body, and in addition, is preferably shrunk on thermally.

24 Claims, 5 Drawing Sheets

PLUNGER FOR A DIECASTING MACHINE

BACKGROUND OF THE INVENTION

The invention relates to a plunger, in particular for forcing molten aluminum or brass out of a casting cylinder of a diecasting machine.

Known plungers of this type have a the inner cap inner cover face of which, leaving a coolant space clear, is located at a distance from the front face of the supporting body. The cap sits with its rear margin on an annular shoulder of the supporting body. When the cap has been screwed on, there is a gap between the internal thread of the cap and an extension of the supporting body at which the associated external thread starts. Experience shows that these caps work loose from the supporting body relatively easily during operation. In addition, the coolant space in the cap does not adequately cool the cover wall of the cap. The result of this is that the margin of the cover cap acts with great force against the inner surface of the casting cylinder and is closed. Normally, the instantaneous temperature of the surface of the cap is here around 300° C., while the temperature of the molten aluminum is 700° C. If the cap cools down again after work, a wedge-shaped gap develops between the peripheral margin of the cover wall of the cap, into which gap molten aluminum can penetrate and solidify there and considerably increases the friction between the plunger and cylinder and accordingly also the wear.

OBJECTS AND SUMMARY OF THE INVENTION

The object of the invention is to ensure firm seating of the cap of a plunger on the supporting body and to reduce the wear of the cap as far as possible.

In accordance with a first aspect of the invention, a plunger for forcing molten metal out of a casting cylinder of a diecasting machine includes a supporting body and a cap. The supporting body is made of a material having a first coefficient of expansion and has an external thread and a front face formed thereon. The supporting body also has a feed channel and a return channel formed therein. The cap is formed of a second material having a second coefficient of expansion higher than that of the first material. The cap is attached to the supporting body via an internal thread which cooperates with the external thread of the supporting body and is thermally shrunk onto the supporting body. The cap also has an inner cover face which bears against the front face of the supporting body and which defines an annular channel. The annular channel extends along a periphery of the inner face of the cap and the front face of the supporting body, receives coolant from the feed channel, and draws coolant off through the return channel.

The consequence of the shrinking on of the cap is that the cap is virtually undetachable from the supporting body if it is heated beforehand in the dismantled state of the plunger. By the inner cover face of the cap bearing against the front face of the supporting body, direct, axial force transmission over a large area from the supporting body to the cap is possible without the thread and the thread of the cap being loaded.

Owing to the fact that the cooling, primarily takes place through the annular channel which extends along the periphery of the inner end face of the cap particularly effective cooling of the peripheral margin of the end face takes place, which prevents considerable radial expansion of the end wall during heating, so that the abovementioned shortcomings do not occur. Calcareous water, from which lime is deposited in the plunger at the hottest spots, is often used as coolant. The hottest spots lie in the cap. In addition, the cap is a part subject to wear and must occasionally be replaced. During replacement, the lime deposited in the cap is removed at the same time.

The invention makes it possible to use caps which have thinner walls compared with known caps, which leads to improved cooling and considerable saving of material.

It is possible to produce caps of the same type in different and to therefore adapt them to supporting bodies of different diameter is without the cooling effect being impaired.

In a particularly simple design, coolant is fed from and drawn off from the annular channel by providing a feed channel which extends axially through the supporting body, an orifice of the feed channel which is formed in the front face of the supporting body, radial channels, located in the front face of the supporting body, which connect the orifice to the annular channel, and return channels, connected to the annular channel, which are provided in the periphery of the supporting body between the radial channels. As a further design simplification, the return channels may have sections which are angled inwardly and which combine to form a common annular return channel which surrounds the feed channel. In order to reduce the wear resistance, the inner cover face of the cap may have a spherical recess formed therein which is disposed opposite the orifice of the feed channel. A particularly large reduction in the wear of the cap is achieved by providing a chamfer around the periphery of the outer cover face of the cap. The chamfer is particularly recommendable when the casting chamber is cooled and when it is ensured that the aluminum solidifies before the pressure phase. If these preconditions are not met, the chamfer can be omitted.

The cooling channels are designed in such a way that the coolant flow becomes turbulent, which results in particularly favorable cooling.

The temperature of the casting cylinder increases with an increasing filling ratio of the casting cylinder and an increasing weight of the casting material in the casting cylinder. If the clearance between the plunger and the casting cylinder increases—for instance on account of different thermal expansion or on account of wear—molten aluminum can penetrate into the intermediate space between the plunger and the casting cylinder and can not only damage the inner surface of the casting cylinder but can also shorten the life of the plunger. In order to avoid this, the cap has a cylindrical shoulder on its outer cover face. The extension has an annular recess for accommodating an inner annular web of a sealing ring. This not only prevents the penetration of molten aluminum into the clearance between the plunger and the casting cylinder, but also improves the quality of the castings, especially if casting is carried out under vacuum. The optimum cooling, essential to the invention, of the plunger is not impaired by the sealing ring, which is a precondition for long life; on the contrary, the sealing ring is also cooled. The sealing ring can be shrunk on the extension in a manner which is known per se.

Simplified mounting and replacement is obtained if the sealing ring is split radially labyrinth-like in a sealing manner.

The split portion, sealing like a labyrinth, of the sealing ring is preferably designed in such a way that the sealing ring, even if it is stretched somewhat, is always tight, so that the sealing ring, even during sudden heating, can expand without losing its sealing effect.

The sealing ring is to be made of an alloy which has the highest possible resistance to abrasion and high endurance. An alloy of high resistance to thermal shocks, high wear resistance, high thermal conductivity, and high elasticity up to 200° C. In this case, an alloy made of hot-working steel is particularly suitable, in which case the hot-working steel can undergo special treatment against corrosion. Other particularly suitable alloy is are a copper alloy or an alloy of $CuBe_2$.

The sealing ring in the abovementioned embodiments can be used only owing to the effective cooling of the plunger according to the invention.

So that the aluminum, in particular in the end phase of casting, presses the sealing ring onto the inner surface of the casting cylinder, as a result of which the desired sealing between casting cylinder and plunger is increased, and so that the aluminum can solidify before it passes into the annular recess, the preferred design includes a shoulder having boundary surfaces facing each other in a V-shape.

So that the sealing ring can absorb a high amount of applied pressure during casting, the shoulder defines an annular shoulder surface on which the sealing ring bears.

So that the sealing ring can be mounted without difficulty, the radially inner boundary of the sealing ring has an inclined contact surface.

In order to ensure that the sealing ring always remains centered and offers only slight resistance to the plunger being pulled out of the casting cylinder, the radially outer boundary of the sealing ring facing the outer cover face of the cap comprises a centering inclined contact surface.

In order to secure the sealing ring to a plunger of small diameter when the plunger is not yet assembled, the side face of the annular web facing the cover face of the cap has granular indentations in the sealing ring.

So that the split sealing ring can be easily mounted and replaced, it has axially directed, conical holes, for the ends of a collet chuck to engage, on either side of its split portion. In such a design, the sealing ring, even under working temperatures of 100° to 300° C. in the casting chamber and expansion of the casting chamber in accordance with the temperature, can even be mounted during two working cycles when it is oversized, which is of particular importance for casting machines working fully automatically.

When molten aluminum passes through despite the design of the sealing ring the cap is provided with a section of reduced outside diameter next to the rear boundary surface of the sealing ring, so that the aluminum passing through and solidifying can be collected. In this design, the aluminum which has passed through and solidified is removed by compressed air when the plunger is moved out until opening of the die. The removal of such residues of aluminum, which adhere between the clearance of the plunger and the casting chamber, is of particular importance, since the residues of aluminum, during a return movement of the plunger, form ridges on the plunger which contribute considerably to premature wear of the plunger, increase the clearance between plunger and casting chamber and can lead to jamming of the plunger.

In order to avoid damaging the sealing ring if too little or no aluminum is present and injection is carried out all the same, the front boundary surface of the cap is designed to project beyond the front surface of the sealing ring.

By a sealing ring designed according to the invention, the following advantages in particular are achieved:

a) The wear on the casting chamber is reduced.
b) The quality of the castings is increased, since jamming during the pressing phase is prevented.
c) It is not necessary to replace the plunger, but only the sealing ring, which results in a considerable saving of time.
d) Since the sealing ring can be mounted quickly, it is possible to mount an oversized sealing ring.

BRIEF DESCRIPTION OF THE DRAWINGS

The invention is described below by an exemplary embodiment with reference to the appended drawings, in which description only molten aluminum is referred to as casting metal for the sake of brevity.

DETAILED DESCRIPTION OF THE PREFERRED EMBODIMENTS

Figure 1:
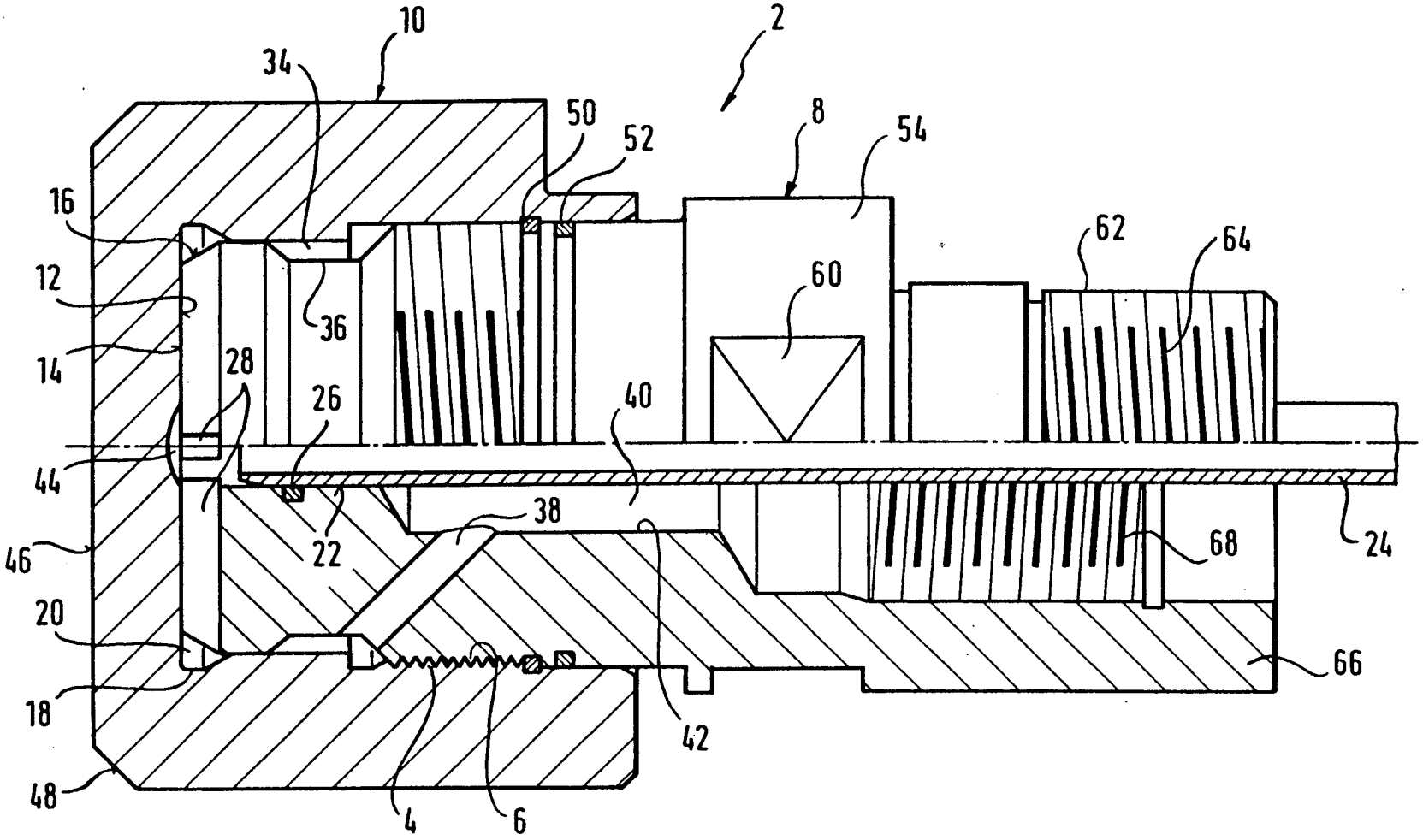
FIG. 1 shows an axial section through a plunger. The top half and the bottom half identify slightly different embodiments.
Figure 2:
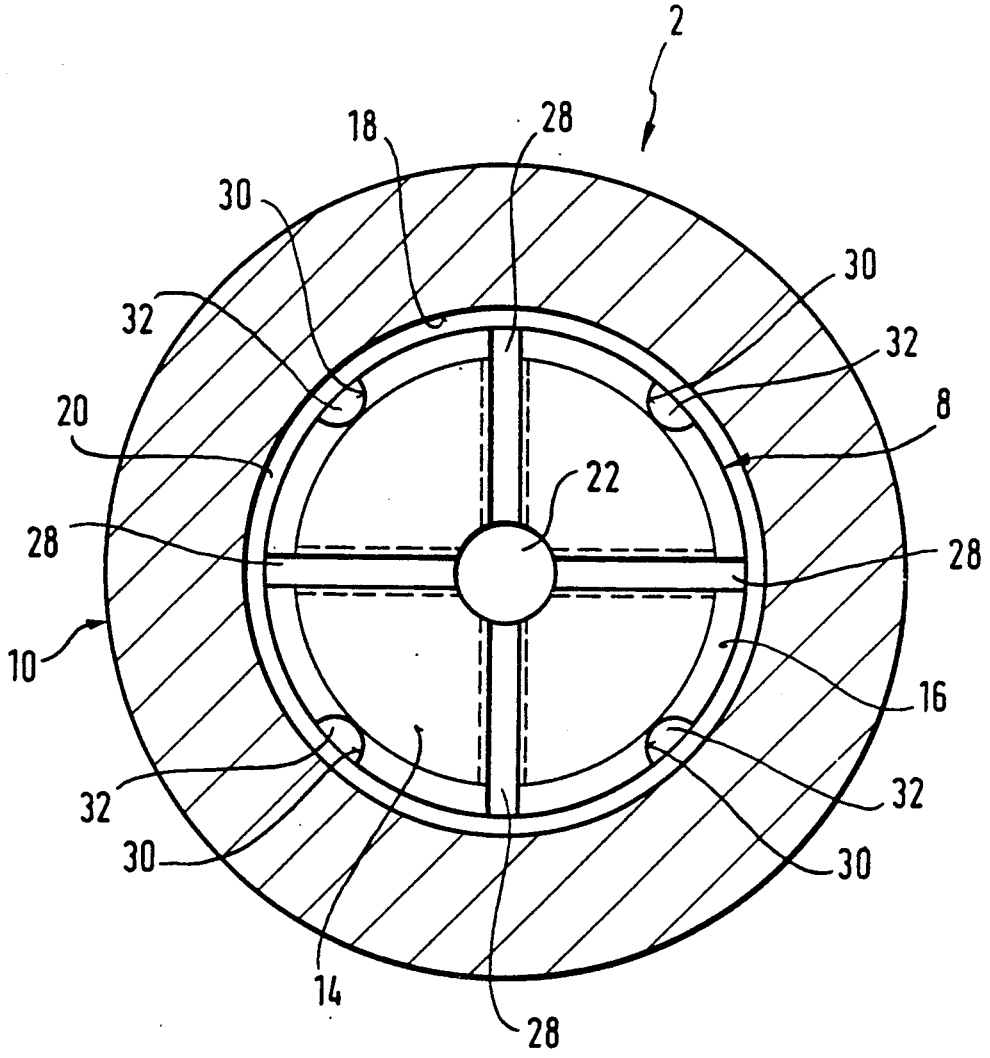
FIG. 2 shows an end elevation of the plunger.

The plunger 2 in the exemplary embodiment serves to force molten aluminum out of a casting cylinder of a diecasting machine (not shown). The plunger 2 has a copper-alloy cap 10 screwed by means of an internal thread 4 onto an external thread 6 of a supporting body 8. The cylinder (not shown) is made of steel, and the supporting body 8 is also made of steel. The cap 10, has an inner cover face 12 which bears against a front face 14 of the supporting body 8. It is screwed with its internal thread 4 onto the external thread 6 of the supporting body 8 and shrunk on thermally. During cooling, the cap 10 tightens around the supporting body 8 and is thereby blocked.

At its end leading to the front face 14, the supporting body 8 has a conical bevel 16 which tapers towards the front face 14 and is surrounded by an annular recess 18 in the cap 10 so that an annular channel 20 results which extends along the periphery of the inner cover face 12 of the cap 10 and along the periphery of the front face 14 of the supporting body 8.

A feed channel for the coolant runs axially through the supporting body 8. To this end, the supporting body 8 has an axial bore 22 into which a coolant feed tube 24 is inserted and sealed off from the bore 22 next to its discharge end by an annular seal 26 inserted into the bore 22. Located in the front face 14 of the supporting body 8 are radial channels 28 which connect the orifice of the feed channel 22 in the front face 14 of the supporting body 8 to the annular channel 20. In the periphery of the supporting body 8, recesses 30 are provided between the radial channels 28, which recesses 30, together with the circumferential surface of the cap 10, define return channels 32 starting at the annular channel 20. The recesses 30, and thus the return channels 32, lie offset in the peripheral direction relative to the radial channels 28 so that the coolant is forced to flow in the peripheral direction through the annular channel 20. The return channels 32 open into an annular space 34 between a peripheral step 36 of the supporting body 8 and the circumferential surface of the cap 10. Starting at this annular space 34 are channel sections 38 which are directed inwards at an angle and open into a common return channel 40 which is annular in cross section. This return channel 40 is formed between an inner annular recess 42, the bore 22 of the supporting body 8, and the tube 24.

The inner cover face 12 of the cap 10 has a spherical recess 44 formed opposite the orifice of the bore 22.

The outer cover face 46 of the cap 10 is provided all round with a chamfer 48.

The periphery of the supporting body 8 is sealed off from the cap 10 next to the end of the latter by annular seals 50, 52 which are inserted into the periphery of the supporting body 8.

In the embodiment in accordance with the top half of FIG. 1, the supporting body 8, behind the cap 10, has a widened portion 54 on which a gripping surfaces 60 for a tool are located. The rear end of the supporting body 8 consists of a shank 62 having an external thread 64 which is to be screwed onto a hollow plunger rod.

In the embodiment according to the bottom half of FIG. 1, the supporting body 8, at its rear end, has a widened portion 66 having an internal thread 68 into which a hollow plunger rod having an external thread is to be screwed.

Figure 4:
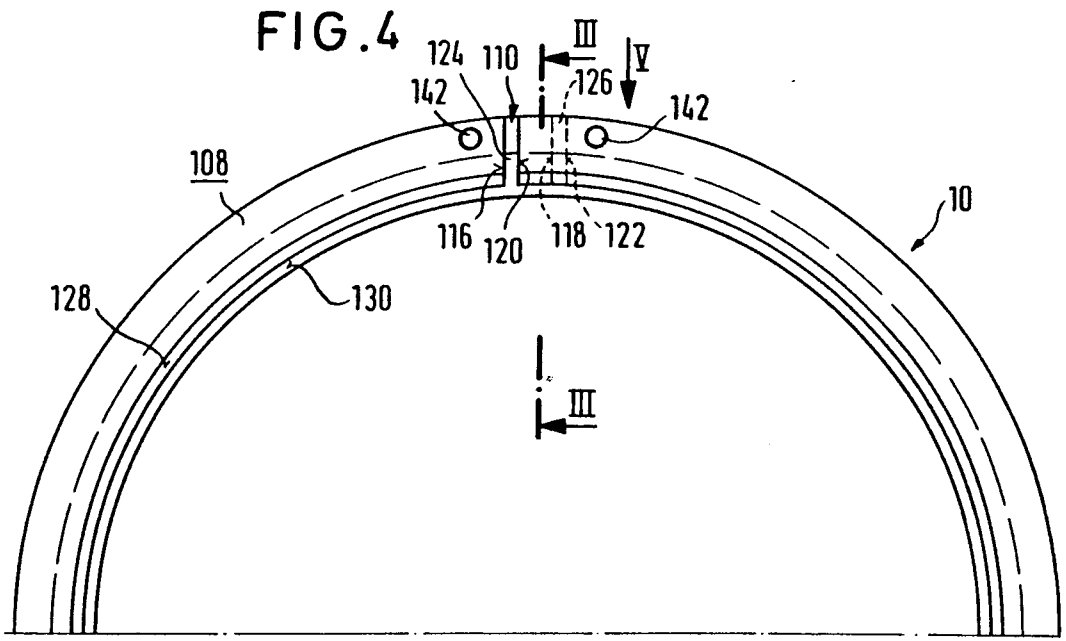
FIG. 4 shows a view in direction IV in FIG. 3.
Figure 5:
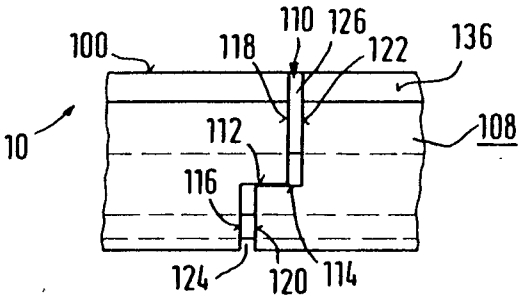
FIG. 5 shows a view in direction V in FIG. 4.
Figure 3:
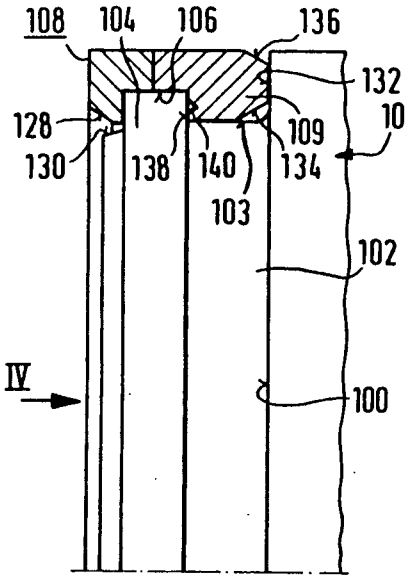
FIG. 3 shows a radial section through a second embodiment of a cap with a sealing ring attached to its outer cover face, according to section III—III in FIG. 4.

FIGS. 3 to 5 show a cap 10 which, on its outer cover face 100, has a cylindrical extension 102 with an outer annular web 104. This annular web 104 engages into an inner annular groove 106 of a sealing ring 108. The sealing ring 108 is split radially in a step shape at a location 110. The sealing ring 108 is preferably mounted in such a way that its split portion lies at the bottom part of the casting cylinder, since the aluminum solidifies here sooner. The transition surfaces 112, 114 between the step surfaces 116, 118, 120, 122 bear tightly against one another. Clearance spaces 124, 126 are located between the step surfaces 116, 120 on the one hand and 118, 122 on the other hand. The sealing ring 108 can thus be stretched somewhat and compressed somewhat without the seal between the transition surfaces 112 and 114 being affected. The cylindrical extension 102 is provided with an annular recess 103 which serves to accommodate an inner annular web 109 of the sealing ring 108. On both sides of its split portion, the sealing ring 108 has axially directed, conical holes 142 for the ends of a collet chuck to engage in.

The sealing ring 108 and the extension 102, have boundary surfaces 128, 130 at the front side facing each other in a V-shape. The sealing ring 108 bears against an annular shoulder surface 132 of the outer cover face 100 of the cap 10, which annular shoulder surface 132 is radially defined by the extension 102. The radially inner boundary of the sealing ring 108 facing the outer cover face 100 of the cap 10 is designed as an inclined contact surface 134. The radially outer boundary of the sealing ring 108 facing the outer cover face 100 of the cap 10 is designed as a centering inclined contact surface 136 which, if it is omitted, can also be provided on the casting cylinder.

The side face 138 of the annular web 104 facing the cover face 100 of the cap 10 has granular projections 140 for engaging in granular indentations in the sealing ring 108.

Figure 6:
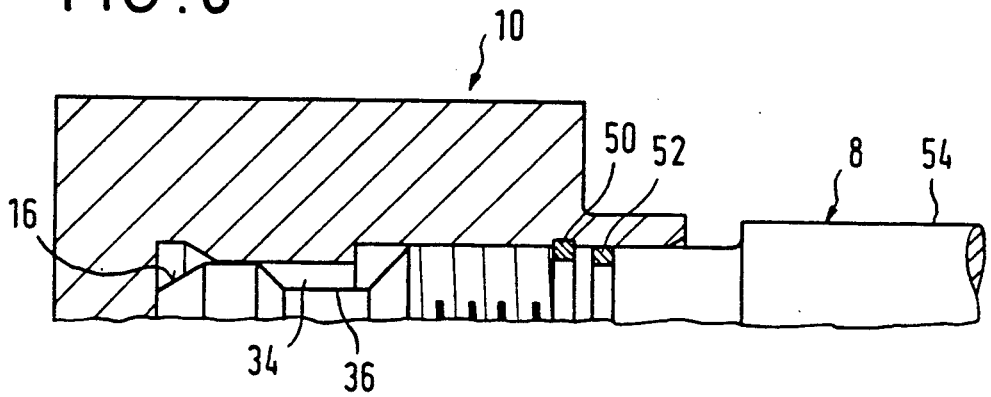
FIG. 6 shows a partial radial section through a third embodiment of a cap.

Compared with the embodiment in FIG. 1, the chamfer is omitted in the embodiment in FIG. 6.

Figure 7:
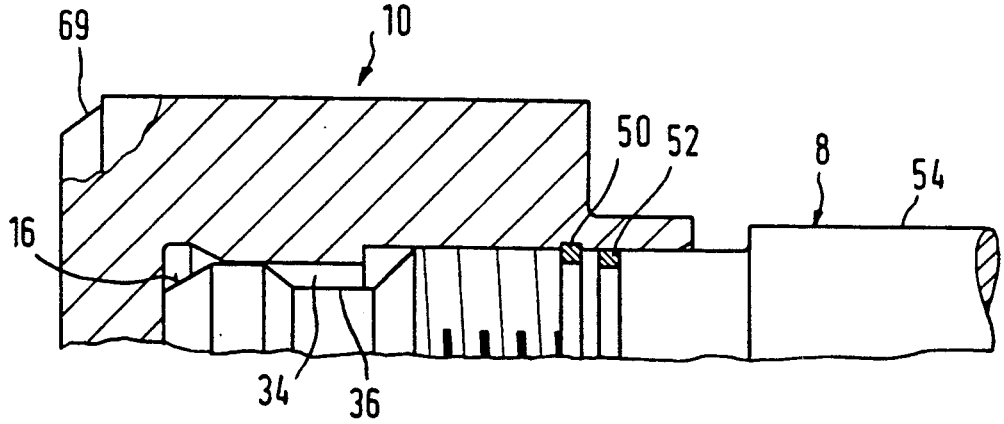
FIG. 7 shows a partial radial section through a fourth embodiment of a cap.

In the embodiment in FIG. 7, the cap 10 is provided with a frustum-shaped extension 69 at the end face. In the embodiment in FIG. 8, the cap 10, next to the rear boundary surface 111 of the sealing ring 108, has a section 11 of reduced outside diameter.

Figure 9:
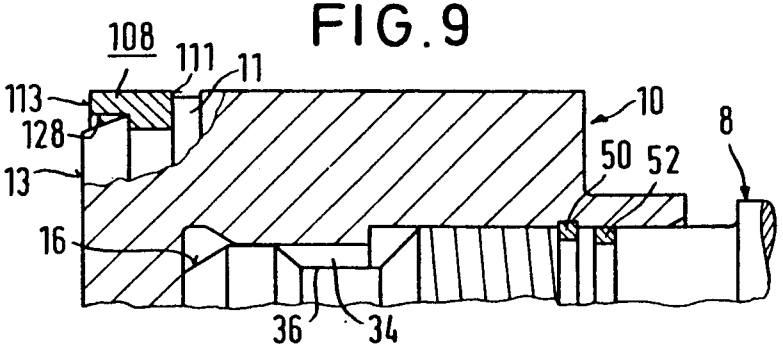
FIG. 9 shows a partial radial section through a sixth embodiment of a cap.
Figure 10:
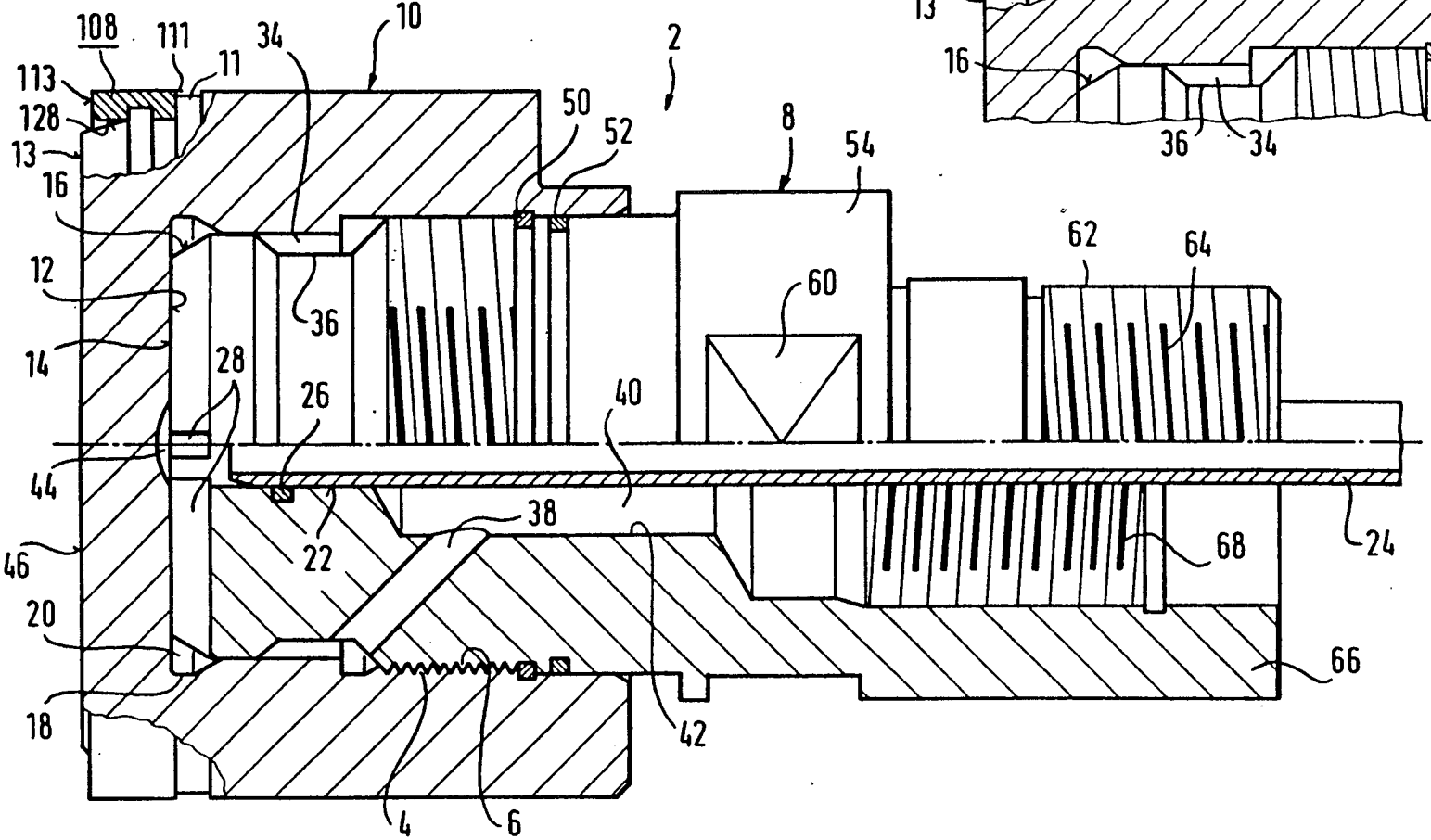
FIG. 10 shows a radial section through a seventh embodiment of a cap.

The embodiment in FIGS. 9 and 10 is of corresponding design.

Figure 8:
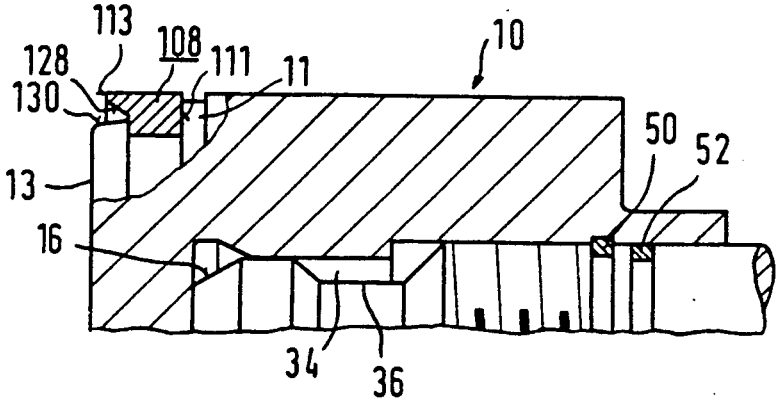
FIG. 8 shows a partial radial section through a fifth embodiment of a cap.

In the embodiments in FIGS. 8 to 10, the front boundary surface 13 of the cap 10 projects beyond the front boundary surface 113 of the sealing ring 108.

In the embodiment in FIG. 8, the surfaces 128, 130 run in a wedge shape at an angle to the longitudinal axis of the plunger. In the embodiment in FIG. 9 the surface 128 runs axially. In the embodiment in FIG. 10 the surface 128 likewise runs axially.

I claim:

1. A plunger for forcing molten metal out of a casting cylinder of a diecasting machine, comprising:

(A) a supporting body which is made of a material having a first coefficient of expansion and which has an external thread and a front face formed thereon, said supporting body having a feed channel and a return channel formed therein; and (B) a cap which is formed of a second material having a second coefficient of expansion higher than that of said first material, said cap being attached to said supporting body via an internal thread which engages said external thread of said supporting body and being thermally shrink fitted onto said supporting body, said cap having an inner cover face which bears against said front face of said supporting body and which defines an annular channel which extends along a periphery of said inner face of said cap and said front face of said supporting body, which receives coolant from said feed channel, and from which coolant is drawn off through said return channel.

2. A plunger according to claim 1, wherein said feed channel extends axially through said supporting body, an orifice of said feed channel is formed in said front face of said supporting body, radial channels, located in said front face of said supporting body, connect said orifice to said annular channel, and return channels, connected to said annular channel, are provided in said periphery of said supporting body between said radial channels.

3. A plunger according to claim 2, wherein said return channels have sections which are angled obliquely inwardly and which combine to form a common annular return channel which surrounds said feed channel.

4. A plunger according to claim 2, wherein said inner cover face of said cap has a concave recess formed therein which is disposed opposite said orifice of said feed channel.

5. A plunger according to claim 2, wherein a chamfer is provided around said periphery of said outer cover face of said cap.

6. A plunger according to claim 1, wherein said plunger is composed of brass and said supporting body is composed of steel.

7. A plunger according to claim 1, wherein said second coefficient of expansion is higher than that of said cylinder.

8. A plunger for forcing molten metal out of a casting cylinder of a diecasting machine, comprising:

(A) a supporting body which is made of a material having a first coefficient of expansion and which has an external thread and a front face formed thereon;

(B) a sealing ring having a frontal boundary surface and an inner annular ridge formed thereon; and (C) a cap which is formed of a second material having a second coefficient of expansion higher than that of said first material, said cap being attached to said supporting body via an internal thread which engages said external thread of said supporting body, said cap having (i) an outer cover face, and (ii) a cylindrical shoulder located on said outer cover face, said shoulder having an annular recess for accommodating said inner annular ridge of said sealing ring, a frontal boundary surface of said shoulder and said frontal boundary surface of said sealing ring being slanted towards each other in a V-shaped manner.

9. A plunger according to claim 8, wherein said sealing ring is shrink fitted onto said shoulder.

10. A plunger according to claim 8, wherein an annular groove, split radially in a labyrinth-like manner, is formed in said sealing ring, and wherein said shoulder has an annular ridge which engages said annular groove in said sealing ring.

11. A plunger according to claim 8, wherein said sealing ring is made from a material having a high thermal fatigue resistance, a high wear resistance, a high thermal conductivity, and a high spring force up to 200° C.

12. A plunger according to claim 8, wherein said sealing ring is made from a hot-worked steel.

13. A plunger according to claim 8, wherein said sealing ring is made from a copper alloy.

14. A plunger according to claim 8, wherein said sealing ring is made from a $CuBe_2$ alloy.

15. A plunger according to claim 8, wherein an annular shoulder surface is formed on said outer cover face of said cap and is defined by said shoulder, and wherein said sealing ring abuts against said annular shoulder surface.

16. A plunger according to claim 8, wherein said sealing ring has a radially outer boundary surface which faces said outer cover face of said cap and which defines an inclined centering inclined contact surface.

17. A plunger according to claim 8, wherein said sealing ring has a radially inner boundary surface which faces an inner cover face of said cap and which defines an inclined centering inclined contact surface.

18. A plunger according to claim 8, wherein said shoulder has an annular ridge formed thereon, and wherein a lateral surface of said annular ridge facing said outer cover face of said cap comprises small projections which engage granular indentations in said sealing ring.

19. A plunger according to claim 10, wherein axially oriented conical holes are formed on either side of said annular groove of said sealing ring and form a grip for a collet chuck.

20. A plunger according to claim 8, wherein said sealing ring has a rear boundary surface, and wherein said cap has a reduced diameter portion which is disposed adjacent said rear boundary surface of said sealing ring.

21. A plunger according to claim 8, wherein said cap is made of a copper alloy.

22. A plunger according to claim 8, wherein said support body is made of steel.

23. A plunger according to claim 8, wherein said second coefficient of expansion is higher than that of said cylinder.

24. A plunger according to claim 8, wherein said internal thread of said cap is thermally shrink fitted onto said external thread of said supporting body.

* * * * *